US008929783B2

(12) United States Patent
Nishina et al.

(10) Patent No.: US 8,929,783 B2
(45) Date of Patent: Jan. 6, 2015

(54) IMAGE FORMING APPARATUS, METHOD FOR PERFORMING IMAGE CORRECTION USING THE SAME AND COMPUTER READABLE STORAGE MEDIUM

(71) Applicants: Hiroaki Nishina, Kanagawa (JP); Tadashi Shinohara, Kanagawa (JP); Yasuhiro Abe, Kanagawa (JP); Yutaka Ohmiya, Tokyo (JP)

(72) Inventors: Hiroaki Nishina, Kanagawa (JP); Tadashi Shinohara, Kanagawa (JP); Yasuhiro Abe, Kanagawa (JP); Yutaka Ohmiya, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/024,825

(22) Filed: Sep. 12, 2013

(65) Prior Publication Data

US 2014/0072351 A1 Mar. 13, 2014

(30) Foreign Application Priority Data

Sep. 13, 2012 (JP) ..... 2012-202100

(51) Int. Cl.

*G03G 15/01* (2006.01)
*G03G 13/01* (2006.01)
*G03G 15/00* (2006.01)

(52) U.S. Cl.

CPC ..... *G03G 13/01* (2013.01); *G03G 15/0105* (2013.01); *G03G 15/0189* (2013.01); *G03G 15/5058* (2013.01); *G03G 2215/0158* (2013.01)

USPC ..... 399/301

(58) Field of Classification Search

USPC ..... 399/301; 347/116

See application file for complete search history.

(56) References Cited

U.S. PATENT DOCUMENTS

| | | | | |
|---|---|---|---|---|
| 6,911,993 | B2 * | 6/2005 | Nishikawa et al. | 347/116 |
| 7,580,661 | B2 * | 8/2009 | Aikawa | 399/301 |
| 7,952,774 | B2 * | 5/2011 | Ikeda | 399/301 |
| 2012/0008154 | A1 * | 1/2012 | Abe | 358/1.9 |

FOREIGN PATENT DOCUMENTS

| | | |
|---|---|---|
| JP | 3743516 | 11/2005 |
| JP | 2009-169031 | 7/2009 |

* cited by examiner

*Primary Examiner* — Sandra Brase

(74) *Attorney, Agent, or Firm* — Harness, Dickey & Pierce, P.L.C.

(57) ABSTRACT

An image forming apparatus comprising: at least one first image carrier; an image writing unit configured to write the electrostatic latent image including a test pattern; a second image carrier configured to move along a transfer position facing to the at least one first image carrier; an image forming unit configured to transfer the subject image transferred on the second image carrier to a transfer material; a detector configured to detect the test pattern image; and a controller configured to correct an image forming condition of the subject image, wherein during a period from the detection of the test pattern to the writing a subsequent subject image, the controller calculates a correction amount of a correction matter, and reflects the calculated amount in the image forming condition of the subject image.

9 Claims, 12 Drawing Sheets

IMAGE FORMING APPARATUS, METHOD FOR PERFORMING IMAGE CORRECTION USING THE SAME AND COMPUTER READABLE STORAGE MEDIUM

CROSS-REFERENCE TO RELATED APPLICATIONS

The present application claims priority to and incorporates by reference the entire contents of Japanese Patent Application No. 2012-202100 filed in Japan on Sep. 13, 2012

BACKGROUND OF THE INVENTION

1. Field of the Invention

The present invention relates to an image forming apparatus, an image forming method, a computer program, and a computer-readable storage medium.

2. Description of the Related Art

A known image forming apparatus forms an electrostatic latent image on a photosensitive element through optical writing, temporarily transfers a toner image of each color obtained through development of the electrostatic latent image onto an intermediate transfer member, such as an intermediate transfer belt, to thereby superimpose the toner images of different colors one on top of another on the intermediate transfer member, and transfers and fixes the toner image of each color from the intermediate transfer member onto and in paper, thereby obtaining a color image.

During continuous printing operations performed by such an image forming apparatus, a known color shift correcting unit simultaneously forms a print image in an image forming area of the intermediate transfer belt and a pattern for detecting a color shift amount in an area outside the image forming area and detects with, for example, a sensor the color shift amount from the pattern on the area outside the image forming area, thereby correcting the color shift according to the detected color shift amount.

Additionally, some copiers and multifunction peripherals (MFPs) that incorporate a plurality of functions of, for example, a copier, facsimile, and printer in one housing form a toner test pattern on the intermediate transfer belt and cause sensors to detect the toner test pattern in order to make image adjustments including color shift correction and density correction. The sensors that detect the test pattern are disposed at positions different from each other in a main-scanning direction. The test pattern is formed at a position on the intermediate transfer belt so as to be detected by each of the sensors.

To reduce downtime during which no print operations can be performed due to image adjustments, a test pattern is formed on either end outside a main scanning image area concurrently with printing for image adjustments.

In order to perform color shift correction during continuous printing operations, Japanese Patent No. 3743516 discloses a method for correcting a color shift amount, in which a color shift detecting pattern is formed simultaneously with a print image during continuous printing operations.

The related-art color shift correcting unit during continuous printing operations, however, performs the correction during the continuous printing operations. Thus, depending on timing at which the correction is reflected, it may take a long time before a correction amount is reflected, which results in a faulty image occurring before the correction amount is properly reflected. Alternatively, an approach has been taken to perform color shift correction at longer printing intervals allowed with the aim of preventing the faulty image from occurring due to the long time required before the color shift correction amount is reflected. This has led to time loss.

The technique disclosed in Japanese Patent No. 3743516 corrects the color shift amount during continuous printing operations by temporarily interrupting a print operation at some time and allowing longer printing intervals at other times. Thus, the technique disclosed in Japanese Patent No. 3743516 involves loss of time, such as time during which the print operation is temporarily interrupted and time allowed for longer printing intervals, specifically, what is called time-related loss.

The present invention has been made in view of the foregoing situation and it is an object of the present invention to perform color shift correction in an image forming apparatus without allowing time loss or time-related loss to occur.

SUMMARY OF THE INVENTION

It is an object of the present invention to at least partially solve the problems in the conventional technology.

According to an aspect of the invention, an image forming apparatus is provided. The image forming apparatus includes: at least one first image carrier configured to carry an electrostatic latent image thereon; an image writing unit configured to write the electrostatic latent image onto the at least one first image carrier, the electrostatic latent image including a test pattern; a second image carrier configured to move along a transfer position facing to the at least one first image carrier to obtain a subject image by transferring the electrostatic latent image carried on the at least one first carrier onto the second image carrier in a superimposing manner; an image forming unit provided in contact with the second image carrier and configured to transfer the subject image transferred on the second image carrier to a transfer material and convey the transfer material; a detector configured to detect the test pattern image; and a controller configured to correct an image forming condition of the subject image based on the detection result from the detector, wherein during a time period from the start of detecting the test pattern by the detector to the start of writing a subsequent subject image onto the at least one first image carrier by the image writing unit, the controller calculates an amount of at least one correction matter from the detection result from the detector, and reflects the calculated amount in the image forming condition of the subject image.

According to another aspect of the invention, a method for performing image correction using an image forming apparatus is provided. The image forming apparatus includes: at least one first image carrier configured to carry an electrostatic latent image thereon; an image writing unit configured to write the electrostatic latent image onto the at least one first image carrier, the electrostatic latent image including a test pattern; a second image carrier configured to move along a transfer position facing to the at least one first image carrier to obtain a subject image by transferring the electrostatic latent image carried on the at least one first carrier onto the second image carrier in a superimposing manner; an image forming unit provided in contact with the second image carrier, and configured to transfer the subject image transferred on the second image carrier to a transfer material and convey the transfer material; a detector configured to detect the test pattern image; and a controller configured to correct an image forming condition of the subject image based on the detection result from the detector. The method includes: by the detector, detecting the test pattern image; by the controller, during a time period from the start of detecting the test pattern by the detector to the start of writing a subsequent subject image onto the at least one first image carrier by the image writing unit, calculating an amount of at least one correction matter from the detection result from the detector, and reflecting the calculated amount in the image forming condition of the subject image; and for at least one delay correction matter being incapable of calculating the correction amount thereof and reflecting the calculated amount in the image forming condition of the subject image during a time period from the start of detecting the test pattern by the detector to the start of writing a subsequent subject image onto the at least one first image carrier by the image writing unit, by the controller, calculating the amount of the at least one delay correction matter and reflecting the calculated amount in the image forming condition of the subject image during an idle period that the image writing unit does not write the electrostatic latent image onto the at least one first image carrier.

According to further aspect of the invention, a computer readable storage medium storing a computer program, the computer program comprising instructions which, when caused by a computer, causes the computer to perform operations for performing image correction using an image forming apparatus is provided. The image forming apparatus includes: at least one first image carrier configured to carry an electrostatic latent image thereon; an image writing unit configured to write the electrostatic latent image onto the at least one first image carrier, the electrostatic latent image including a test pattern; a second image carrier configured to move along a transfer position facing to the at least one first image carrier to obtain a subject image by transferring the electrostatic latent image carried on the at least one first carrier onto the second image carrier in a superimposing manner; an image forming unit provided in contact with the second image carrier and configured to transfer the subject image transferred on the second image carrier to a transfer material and convey the transfer material; a detector configured to detect the test pattern image; and a controller configured to correct an image forming condition of the subject image based on the detection result from the detector. The operations include: by the detector, detecting the test pattern image; by the controller, during a time period from the start of detecting the test pattern by the detector to the start of writing a subsequent subject image onto the at least one first image carrier by the image writing unit, calculating an amount of at least one correction matter from the detection result from the detector, and reflecting the calculated amount in the image forming condition of the subject image; and for at least one delay correction matter being incapable of calculating the correction amount thereof and reflecting the calculated amount in the image forming condition of the subject image during a time period from the start of detecting the test pattern by the detector to the start of writing a subsequent subject image onto the at least one first image carrier by the image writing unit, by the controller, calculating the amount of the at least one delay correction matter and reflecting the calculated amount in the image forming condition of the subject image during an idle period that the image writing unit does not write the electrostatic latent image onto the at least one first image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
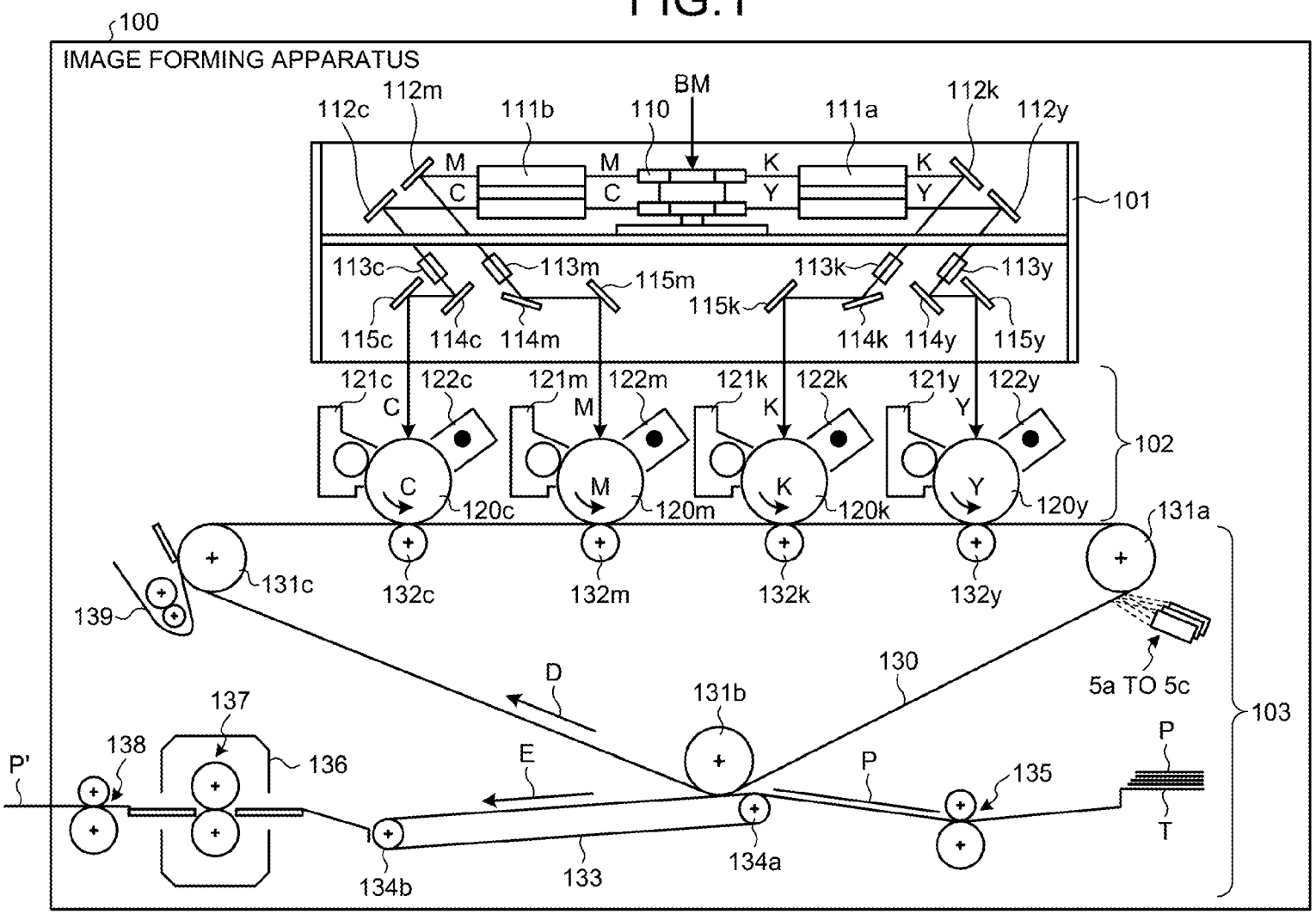
FIG. 1 is a schematic diagram illustrating an exemplary structure of an image forming apparatus that can be applied to an embodiment of the present invention.

An image forming apparatus according to an embodiment of the present invention will be described below with reference to the accompanying drawings. FIG. 1 is a block diagram illustrating an arrangement of the image forming apparatus according to the embodiment. This image forming apparatus 100 may, for example, be a facsimile, a printer, a copier, or a multifunction peripheral. The image forming apparatus 100 includes an optical unit 101, an image forming unit 102, and a transfer unit 103. The optical unit 101 includes optical elements such as a semiconductor laser light source and a polygon mirror. The image forming unit 102 includes, for example, a drum-shaped photosensitive element (also referred to as a "photosensitive drum"), a charger, and a developing unit. The transfer unit 103 includes an intermediate transfer belt. Specifically, the optical unit 101, the image forming unit 102, and the transfer unit 103 perform functions of forming general images and pattern images.

The optical unit 101 includes a polygon mirror 110 that deflects a light beam BM emitted from a plurality of light sources (not illustrated), each of the light sources assuming a semiconductor laser light source including a laser diode (LD), and causes the light beam BM to enter scanning lenses 111*a*, 111*b* including fθ lenses. The light beam is generated in number corresponding to the number of colors of toner of yellow (Y), black (K), magenta (M), and cyan (C). The light beams transmit through the scanning lenses 111*a*, 111*b* and are reflected by reflecting mirrors 112*y*, 112*k*, 112*m*, 112*c*. For example, a yellow light beam Y transmits the scanning lens 111*a*, is reflected by the reflecting mirror 112*y*, and enters a WTL lens 113*y*. This also applies to light beams K, M, and C for black, magenta, and cyan and descriptions therefore will be omitted.

The WTL lenses 113*y*, 113*k*, 113*m*, 113*c* shape the light beams Y, K, M, C, respectively, and then deflect the light beams Y, K, M, C to reflecting mirrors 114*y*, 114*k*, 114*m*, 114*c*, respectively. The light beams Y, K, M, C are further reflected by reflecting mirrors 115*y*, 115*k*, 115*m*, 115*c*, respectively, and reach photosensitive elements 120*y*, 120*k*, 120*m*, 120*c*, respectively, as the light beams Y, K, M, C to be used for exposure, respectively, the light beams Y, K, M, C forming an image.

A plurality of optical elements are employed as described above to irradiate the photosensitive elements 120*y*, 120*k*, 120*m*, 120*c* with the light beams Y, K, M, C. Thus, the photosensitive elements 120*y*, 120*k*, 120*m*, 120*c* are synchronized with each other relative to a main-scanning direction and a sub-scanning direction. Relative to the photosensitive elements 120*y*, 120*k*, 120*m*, 120*c*, the main-scanning direction will here be defined as a scanning direction of the light beam and the sub-scanning direction as a direction orthogonal to the main-scanning direction, specifically, a direction in which the photosensitive elements 120*y*, 120*k*, 120*m*, 120*c* rotate.

Each of the photosensitive elements 120*y*, 120*k*, 120*m*, 120*c* includes a photoconductive layer that includes at least a charge generation layer and a charge transport layer on a conductive drum such as aluminum. The photoconductive layer is associated with each of the photosensitive elements 120*y*, 120*k*, 120*m*, 120*c*. Surface charge is applied to the photoconductive layers by chargers 122*y*, 122*k*, 122*m*, 122*c*, respectively, each including, for example, a corotron, a scorotron, and a roller charging device.

Static charges applied to the photosensitive elements 120*y*, 120*k*, 120*m*, 120*c* by the chargers 122*y*, 122*k*, 122*m*, 122*c*, respectively, are exposed by the light beams Y, K, M, C, respectively, for forming an image. This forms an electrostatic latent image on a scanned surface of each of the photosensitive elements 120*y*, 120*k*, 120*m*, 120*c*.

The electrostatic latent images formed on the scanned surfaces of the photosensitive elements 120*y*, 120*k*, 120*m*, 120*c* are developed by developing units 121*y*, 121*k*, 121*m*, 121*c*, respectively, each of the developing units 121*y*, 121*k*, 121*m*, 121*c* including a developing sleeve, a developer supply roller, and a doctor blade. Developer images are thus formed on the scanned surfaces of the photosensitive elements 120*y*, 120*k*, 120*m*, 120*c*, respectively.

Developers carried on the respective scanned surfaces of the photosensitive elements 120*y*, 120*k*, 120*m*, 120*c* are transferred by primary transfer rollers 132*y*, 132*k*, 132*m*, 132*c* associated, respectively, with the photosensitive elements 120*y*, 120*k*, 120*m*, 120*c* onto an intermediate transfer belt 130 moved in a direction of an arrow D by carriage rollers 131*a*, 131*b*, 131*c*. The intermediate transfer belt 130, while carrying the Y, K, M, and C developers transferred, respectively, from the scanned surfaces of the photosensitive elements 120*y*, 120*k*, 120*m*, 120*c*, is carried onto a secondary transfer section. Specifically, the intermediate transfer belt 130 corresponds to an intermediate transfer member.

The secondary transfer section includes a secondary transfer belt 133 and carriage rollers 134*a*, 134*b*. The secondary transfer belt 133 is carried in a direction of an arrow E by the carriage rollers 134*a*, 134*b*. Carriage rollers 135 supply a sheet P that assumes an image receiving material, such as high quality paper and a plastic sheet, from a paper storage T, such as a paper feeding cassette, to the secondary transfer section. The secondary transfer section applies a secondary transfer bias to thereby transfer a multi-colored developer image carried on the intermediate transfer belt 130 onto the sheet P held by suction on the secondary transfer belt 133. The sheet P is supplied to a fixing unit 136 as the secondary transfer belt 133 is carried. The fixing unit 136 includes fixing members 137, such as fixing rollers that contain therein silicone rubber or fluororubber and pressurizes and heats the sheet P and the multi-colored developer image. Discharging rollers 138 then discharge the sheet P as printed matter P' to an outside of the image forming apparatus 100.

A cleaning section 139 including a cleaning blade removes a residual developer from the intermediate transfer belt 130 that has transferred the multi-colored developer image before the intermediate transfer belt 130 being supplied to a subsequent image forming process.

Three detecting sensors 5*a*, 5*b*, 5*c* are disposed near the carriage roller 131*a*. The detecting sensors 5*a*, 5*b*, 5*c* serve as detectors that detect correction test pattern images (including a "color shift correction test pattern image" and a "density correction test pattern image") for correcting image forming conditions when a color image is to be formed on the intermediate transfer belt 130. A reflection type detecting sensor including a well-known reflection type photo sensor may be employed for each of the detecting sensors 5*a*, 5*b*, 5*c*. Various types of shift amounts, including skew of each color relative to a reference color, a main scanning misregistration amount, a sub-scanning misregistration amount, and a main scanning zoom ratio error, are calculated based on results of detection made by the detecting sensors 5*a*, 5*b*, 5*c*. Then, based on the calculation results, the various types of shift amounts relating to image quality adjustment are corrected and the image forming conditions (positional deviation correction, density correction) with which to form a color image on the intermediate transfer belt 130 are corrected. Various types of processes are thereby performed as they relate to generation of the test pattern images during image adjustment. Specifically, specific color shift correction amounts are concerned with, for example, main scanning misregistration, sub-scanning misregistration, a main scanning general zoom ratio, and skew correction.

Figure 2:
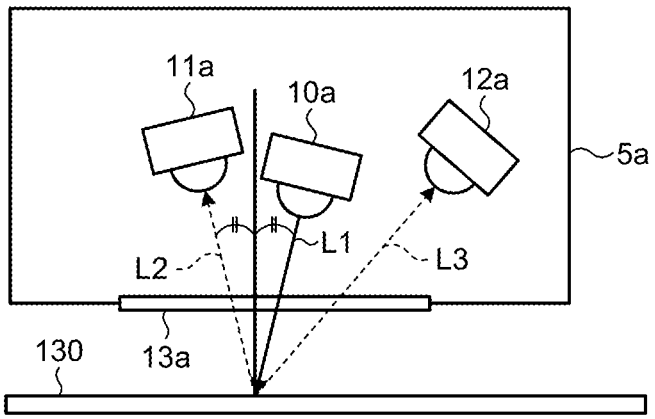
FIG. 2 is a view illustrating a schematic internal configuration of a detecting sensor illustrated in FIG. 1.

FIG. 2 is a view illustrating a schematic internal configuration of the detecting sensors 5*a*, 5*b*, 5*c* in FIG. 1. The detecting sensors 5*a*, 5*b*, 5*c* have a common internal configuration and FIG. 2 illustrates the detecting sensor 5*a*. The detecting sensors 5*b*, 5*c* each have the same internal configuration and descriptions therefore will be omitted.

The detecting sensor 5*a* includes one light emitting part 10*a*, two light receiving parts 11*a*, 12*a*, and a condensing lens 13*a*. The light emitting part 10*a* is a light emitting element that emits light, for example, an infrared LED that emits infrared light. The light receiving part 11*a* is, for example, a regular reflected light receiving element and the light receiving part 12*a* is, for example, a diffuse reflected light receiving element.

In the detecting sensor 5*a*, light L1 emitted from the light emitting part 10*a* transmits through the condensing lens 13*a* to reach a test pattern (not illustrated in FIG. 2) on the intermediate transfer belt 130. Part of the light is regularly reflected on a test pattern forming area or a toner layer on the test pattern forming area to become regular reflected light L2. The regular reflected light L2 then transmits through the condensing lens 13*a* again before being received by the light receiving part 11*a*. Another part of the light is reflected on the test pattern forming area or the toner layer on the test pattern forming area to become diffuse reflected light L3. The diffuse reflected light L3 then transmits through the condensing lens 13*a* again before being received by the light receiving part 12*a*.

It is noted that, in place of the infrared LED, a laser light emitting element, for example, may be employed as the light emitting element. Additionally, phototransistors are used for the light receiving parts 11*a*, 12*a* (the regular reflected light receiving element and the diffuse reflected light receiving element). An element including a photodiode or an amplifier circuit may still be used instead.

Figure 3:
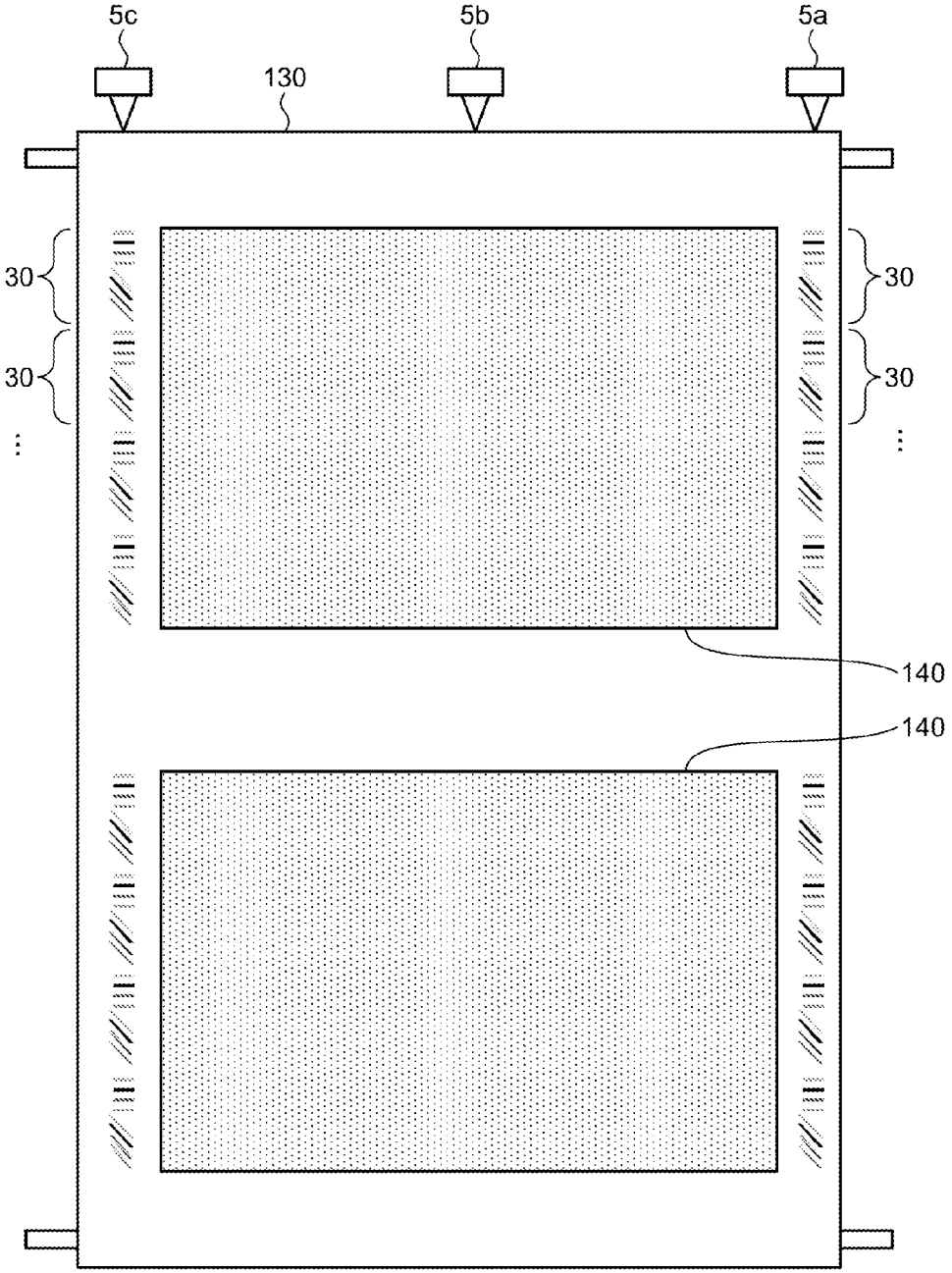
FIG. 3 is a schematic diagram illustrating an exemplary arrangement of a correction test pattern applied to the embodiment.

FIG. 3 illustrates the intermediate transfer belt 130 and the detecting sensors 5*a*, 5*b*, 5*c* when a correction test pattern 30 is formed concurrently with formation of a print image 140 to be transferred to the sheet P. To form the correction test pattern concurrently with image printing, out of a plurality of test pattern detecting sensors, one or more of the test pattern detecting sensors need to be disposed at image area outer end portions in the main-scanning direction of a print image. In FIG. 3, the detecting sensors 5*a* and 5*c* out of the three detecting sensors 5*a*, 5*b*, 5*c* are disposed at the image area outer end portions. In this case, no correction test pattern 30 is formed in a column corresponding to the detecting sensor 5*b* and the test patterns are formed only in columns corresponding to the detecting sensors 5*a* and 5*c* disposed on ends concurrently with the formation of the print image 140. Image forming apparatuses that do not form the correction test pattern concurrently with the print image 140 to be transferred to the sheet P very often include a plurality of detecting sensors all disposed within the print image area in order to acquire adjustment values within the image area.

Figure 4:
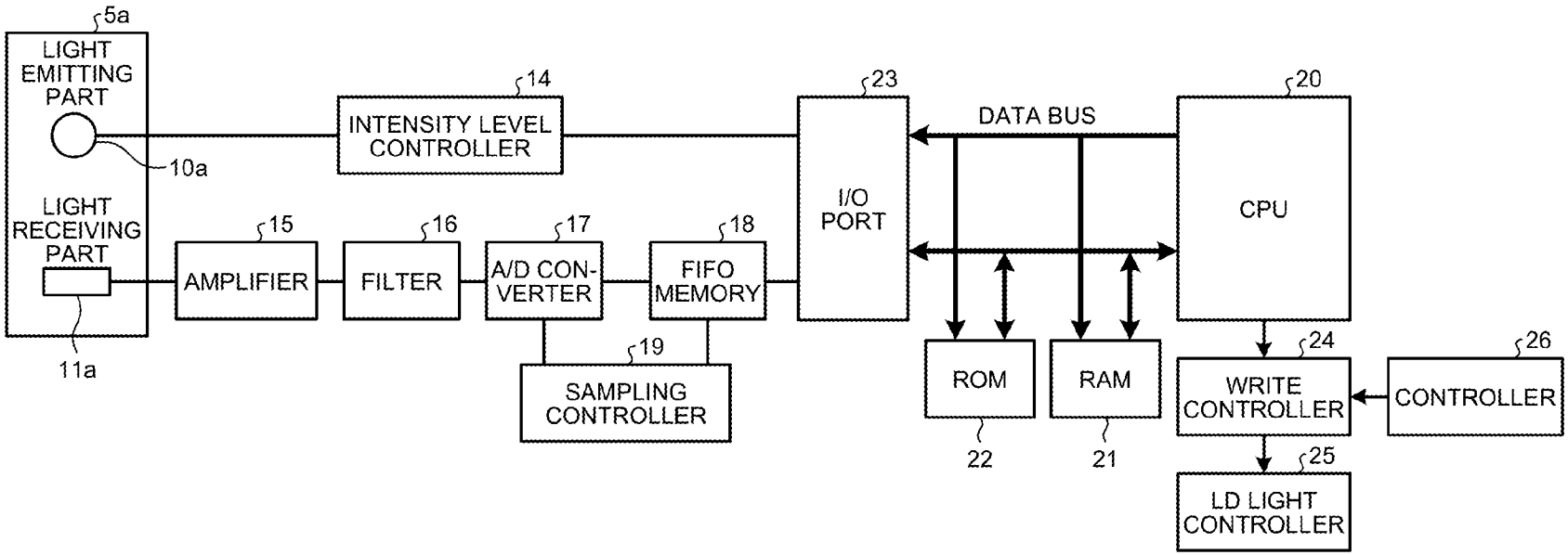
FIG. 4 is a block diagram illustrating an exemplary configuration of a signal processing unit in the image forming apparatus that can be applied to the embodiment of the present invention.

FIG. 4 illustrates an exemplary configuration of a signal processing system in the image forming apparatus 100 that can be applied to the embodiment of the present invention. The signal processing system of the image forming apparatus 100 illustrated in FIG. 4 is concerned mainly with an arrangement for color shift amount detection that is closely related to the embodiment. In addition, the correction test pattern 30 is to be detected using the light receiving part 11*a* that receives the regular reflected light L2 out of the two light receiving parts 11*a*, 12*a* included in the detecting sensor 5*a*.

A central processing unit (CPU) 20 performs predetermined calculations and pattern detection according to the embodiment according to a computer program stored in advance in a read only memory (ROM) 22 and by using a random access memory (RAM) 21 as a work memory. The CPU 20 is connected to an I/O port 23 via a data bus. The I/O port 23 controls reading data from a first-in-first-out (FIFO) memory 18 to be described later and data transfer via the data bus.

In the detecting sensor 5*a*, the light receiving part 11*a*, after having received reflected light of infrared light emitted from the light emitting part 10*a*, outputs an analog detection signal corresponding to intensity of the received infrared light. This analog detection signal is amplified by an amplifier 15. A filter 16 selectively passes a line detection signal component of the analog detection signal and an A/D converter 17 converts the detection signal to corresponding digital detection data. A sampling controller 19 controls sampling of the detection data converted by the A/D converter 17. The detection data that has undergone sampling at the A/D converter 17 is stored in the FIFO memory 18.

When the detection of one correction test pattern 30 is completed, the sampling controller 19 causes the detection data for the correction test pattern 30 stored in the FIFO memory 18 to be output from the FIFO memory 18. The detection data output from the FIFO memory 18 is supplied to the CPU 20 and the RAM 21 via the I/O port 23. The CPU 20 calculates various types of shift amounts, such as the above-mentioned color shift amount, according to the computer program stored in the ROM 22. The ROM 22 stores therein the computer program for calculating the above-described various types of shift amounts and other computer programs for controlling a positional deviation correcting unit and the image forming apparatus.

The CPU 20 monitors the detection data from the light receiving part 11*a* at appropriate timing; based on a result of the monitoring, the CPU 20 generates a control signal for controlling the level of the infrared light emitted from the light emitting part 10*a* and supplies the control signal to an intensity level controller 14 via the I/O port 23. The intensity level controller 14 controls the intensity level of the light emitting part 10*a* according to this control signal. This allows the level of the infrared light emitted from the light emitting part 10*a* to be made substantially constant, so that the detection of the correction test pattern 30 can be reliably performed even with deterioration of the intermediate transfer belt 130 or of a laser light source not illustrated. As such, the CPU 20 and the ROM 22 function as control units that control general operations of the image forming apparatus 100.

The CPU 20 obtains a color shift correction amount for correcting the color shift amount calculated from the detection result of the correction test pattern 30. To correct the color shift correction amount thus obtained, the CPU 20 sets changes in, for example, writing start timing and a pixel clock frequency in a write controller 24 based on the obtained color shift correction amount.

The write controller 24 includes an arrangement that permits detailed setting of an output frequency, such as, for example, a clock generator that incorporates a voltage controlled oscillator (VCO) and uses this output as a pixel clock. With reference to this pixel clock, the write controller 24 drives an LD light controller 25 according to image data transferred from a controller 26 to control lighting of the laser light source not illustrated, thereby writing images relative to the photosensitive elements 120*y*, 120*k*, 120*m*, 120*c*.

The write controller 24 writes the images relative to the photosensitive elements 120*y*, 120*k*, 120*m*, 120*c* at the write timing or the pixel clock frequency set by the CPU 20 based on the color shift correction amount. This enables the forming of an image whose color shift correction amount has been corrected.

Figure 5:
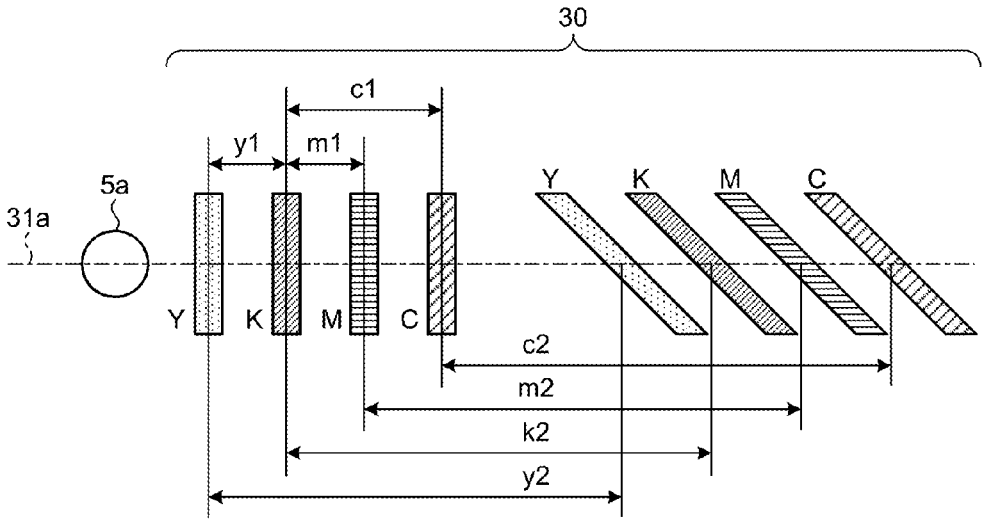
FIG. 5 is a view illustrating one set of correction test patterns scanned by the detecting sensor.

With reference to FIG. 5, the following describes a specific method for calculating various types of positional deviation amounts when the positional deviation correction pattern image illustrated in FIG. 3 is detected. FIG. 5 is a view illustrating the detecting sensor 5*a* and the correction test pattern image that includes one set of marks scanned by the detecting sensor 5*a*. The dash-single-dot line 31*a* in FIG. 5 represents a path along which a central part of the detecting sensor 5*a* scans over the intermediate transfer belt 130 in the sub-scanning direction. FIG. 5 illustrates an exemplary ideal path along which the central part of the detecting sensor 5*a* moves over the central part of the positional deviation correction test pattern 30. While the following describes that the detecting sensor 5*a* detects the marks of the positional deviation correction test pattern 30, the detecting sensor 5*c* operates similarly. Additionally, FIGS. 3 and 5 illustrate an example in which horizontal line marks and slanting line marks are arranged in order of Y, K, M, and C in the direction in which the intermediate transfer belt 130 is carried. Nonetheless, each of the horizontal line marks and the slanting line marks may be arranged in another order of colors.

The detecting sensor 5*a* detects the horizontal line marks and the slanting line marks constituting the positional deviation correction test pattern 30 at predetermined sampling intervals and notifies the CPU 20 in FIG. 3 of detection of each mark. Having received the notification of the detection of the horizontal line marks and the slanting line marks in succession, the CPU 20 calculates a distance between each pair of the horizontal line marks and a distance between each pair of a specific horizontal line mark and a corresponding slanting line mark based on an interval of notification of the detection and a sampling time interval. Various types of positional deviation amounts can be calculated by obtaining the distance between each pair of the horizontal line marks and the distance between each pair of a specific horizontal line mark and a corresponding slanting line mark as described above and by comparing each obtained length among different sets of marks relative to the same color.

A sub-scanning misregistration amount (the color shift amount in the sub-scanning direction) is calculated as follows. Specifically, distance values (y1, m1, c1) between respective pairs of a reference color (K) mark and a target color (Y, M, C) mark are calculated using the horizontal line marks; the distance values (y1, m1, c1) are then compared with previously stored, ideal distance values (y0, m0, c0); the positional deviation amount of each of the target colors (Y, M, C) relative to the reference color (K) can then be obtained by calculating (distance value y1−ideal distance value y0), (distance value m1−ideal distance value m0), and (distance value c1−ideal distance value c0).

A main scanning misregistration amount (the color shift amount in the main-scanning direction) is calculated as follows. Specifically, distance values (y2, k2, m2, c2) between respective pairs of the horizontal line marks and the slanting line marks of respective colors of K, Y, M, and C are first calculated. Using the calculated distance values, a difference value is calculated between the distance value of the reference color (K) and the distance value of each of non-reference colors. The difference value corresponds to the positional deviation amount in the main-scanning direction. This is because the slanting line marks are inclined at a predetermined angle relative to the main-scanning direction. If a shift occurs in the main-scanning direction, the distance from the horizontal line mark of one color is wider or narrower relative to a distance from the horizontal line mark of another color. Specifically, the positional deviation amounts in the main-scanning direction between black and yellow, between black and magenta, and between black and cyan can be obtained from (distance value k2−distance value y2), (distance value k2−distance value m2), and (distance value k2−distance value c2). The misregistration amounts in the sub-scanning and main-scanning directions can be obtained in the foregoing manner.

Skew and the main scanning zoom ratio error can also be obtained based on results of detection made by different pairs of the detecting sensors 5*a*, 5*b*, 5*c*. A skew component can be obtained by calculating a difference between the sub-scanning misregistration amount detected by the detecting sensor 5*a* and that detected by the detecting sensor 5*c*. A zoom ratio error deviation can be obtained by calculating a difference in the main scanning misregistration amount between the detecting sensor 5*a* and the detecting sensor 5*b* and that between the detecting sensor 5*b* and the detecting sensor 5*c*. Based on the various types of positional deviation amounts obtained as described above, a correction process is performed for correcting the image forming conditions applicable to the formation of a color image on the intermediate transfer belt 130.

The correction process includes registration adjustments in the main-scanning direction and the sub-scanning direction and the main scanning general zoom ratio adjustment that are accomplished, for example, by adjusting emission timing of the light beams Y, K, M, C relative to the photosensitive elements 120*y*, 120*k*, 120*m*, 120*c* so as to achieve the positional deviation amounts substantially identical to each other. The registration adjustment in the sub-scanning direction is accomplished by fine-adjusting speeds of the photosensitive elements 120*y*, 120*k*, 120*m*, 120*c* to thereby correct the positional deviation amount relative to the photosensitive element 120*k*. Alternatively, the registration adjustment in the sub-scanning direction may still be accomplished by adjusting the inclination of the reflecting mirror not illustrated that reflects the light beam. The inclination of the reflecting mirror is adjusted by driving a stepping motor not illustrated. The positional deviation amount may even be corrected by changing image data; for example, by adding a while line.

Figure 6:
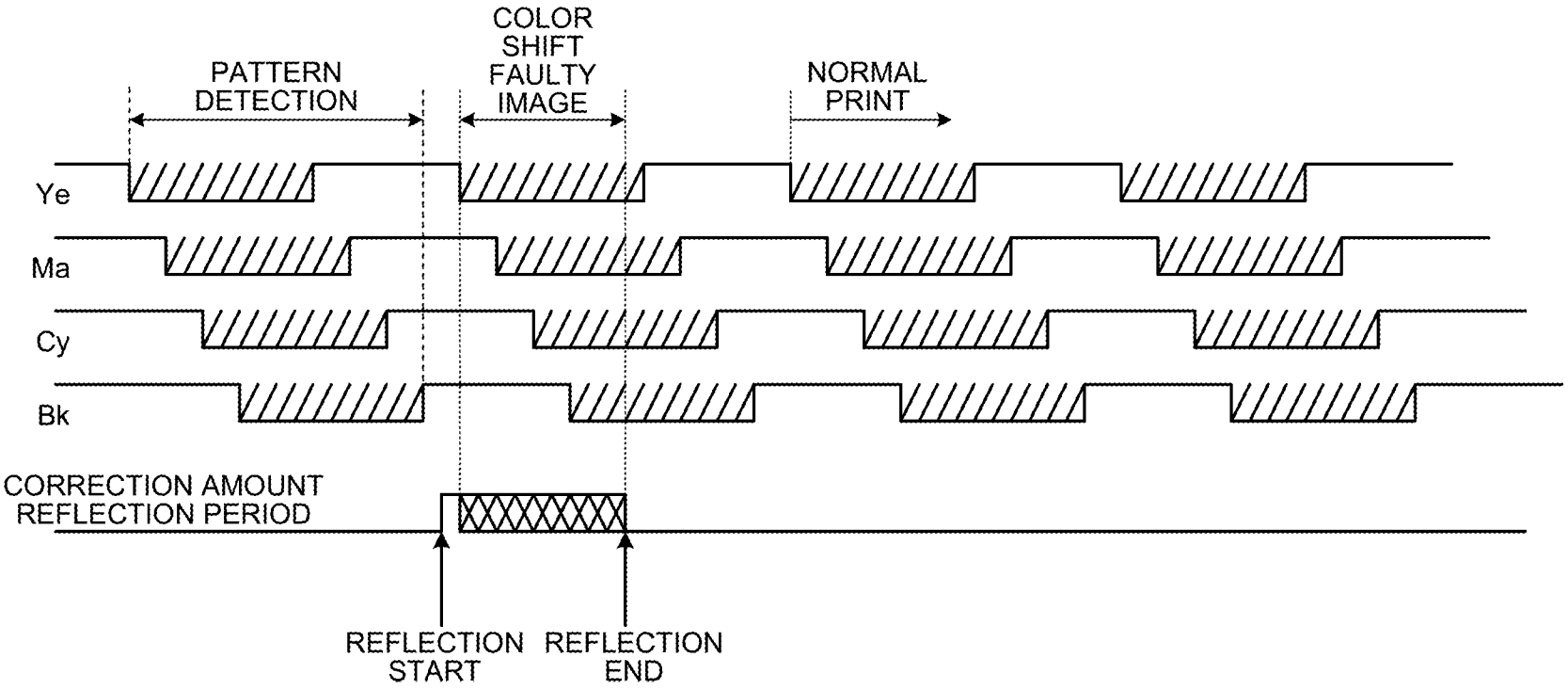
FIG. 6 is a timing chart for illustrating occurrence of a color shift faulty image arising from correction amount reflection timing in the related art.

The following describes occurrence of a color shift faulty image according to timing at which the above-described color shift correction amounts are to be reflected. FIG. 6 illustrates an exemplary timing chart when image formation is performed by the arrangement exemplified in FIG. 1. The upper four signals indicate image forming periods for yellow Ye, magenta Ma, cyan Cy, and black Bk, respectively, the print image being formed while the signal remains a Low level (shaded portions in FIG. 6). The bottom signal indicates a correction amount reflection period during which the signal remains a High level and the correction amount is reflected.

As illustrated in FIGS. 3, 4, and 5, the print image 140 and the correction test pattern 30 for color shift detection are formed concurrently with each other in the pattern detecting area for the detection of the color shift amounts. When the test pattern detection is completed within the period of pattern detection indicated in FIG. 6, the color shift correction amount according to the color shift amount (correction value) is obtained at a point in time at which reflection is started in the correction amount reflection period signal and reflection of the correction amount is performed at the point in time to start the reflection.

It is here noted that, if print image formation is started at any time between a reflection start and a reflection end during continuous printing operations, the print image formation is performed with a different color shift correction amount during the correction reflection period. This results in color shift occurring in an output print image and a faulty image is thus output. To prevent any faulty image from occurring, therefore, the print operations need to be temporarily halted until the reflection of the correction amount is completed. The wait time before the completion of the reflection is time-related loss.

Specifically, preferably, the color shift correction amount is reflected at timing outside the image forming period for fear of variable shift amounts within a page due to color shift correction made during an image printing operation. Focusing on a correction-enabled period, the correction is enabled by adjusting the emission timing of the light beam in the registration adjustments in the main-scanning direction and the sub-scanning direction and the main scanning general zoom ratio adjustment. Specifically, the adjustment can be made by reflecting the correction amount in the write controller 24 illustrated in FIG. 4 and a short time is required for reflecting the correction amount. Meanwhile, the sub-scanning misregistration correction performed through the skew shift correction and fine-adjustments of the photosensitive element speed is achieved by using, for example, a stepping motor. The sub-scanning misregistration correction thus requires a long time before a steady speed or a steady rotational angle is achieved according to the correction amount, which extends the correction amount reflection period.

First Embodiment

Figure 7:
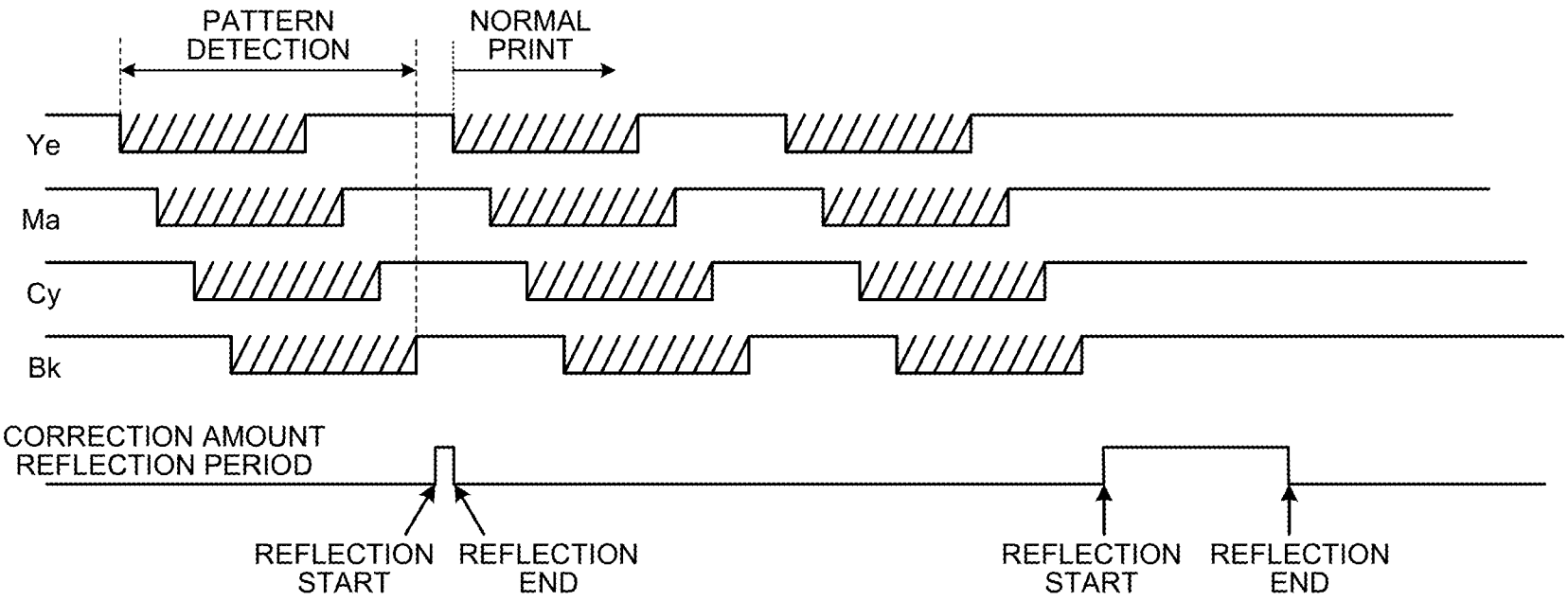
FIG. 7 is a timing chart illustrating correction amount reflection timing according to a first embodiment of the present invention.

A timing chart illustrated in FIG. 7 is then employed in a first embodiment of the present invention. FIG. 7 is a timing chart applicable to image formation according to the first embodiment in the arrangement illustrated in FIG. 1. As illustrated in FIG. 7, with the adjustments of the main scanning registration and sub-scanning registration, and the main scanning general zoom ratio in which the correction amount can be reflected before a subsequent page is printed, the color shift is corrected by reflecting the correction amount for a period of time from the end of the pattern detection to the start of the print cycle for the subsequent page. For the sub-scanning misregistration correction performed through the skew shift correction and change of the photosensitive element speed, which makes it difficult to complete reflection of the correction amount for the period of time from the end of the pattern detection to the start of the print cycle for the subsequent page, the correction amount is reflected at such timing that does not affect the print operation. This enables the color shift correction to be performed without allowing any faulty image to occur.

As described above, for the adjustments of the main scanning registration and sub-scanning registration, and the main scanning general zoom ratio, the correction amount is reflected for the period of time from the end of the pattern detection to the start of the print cycle for the subsequent page. This eliminates the need for suspending a print operation temporarily in order to reflect the correction amount, so that color matching can be performed without allowing time-related loss to occur.

Figure 8:
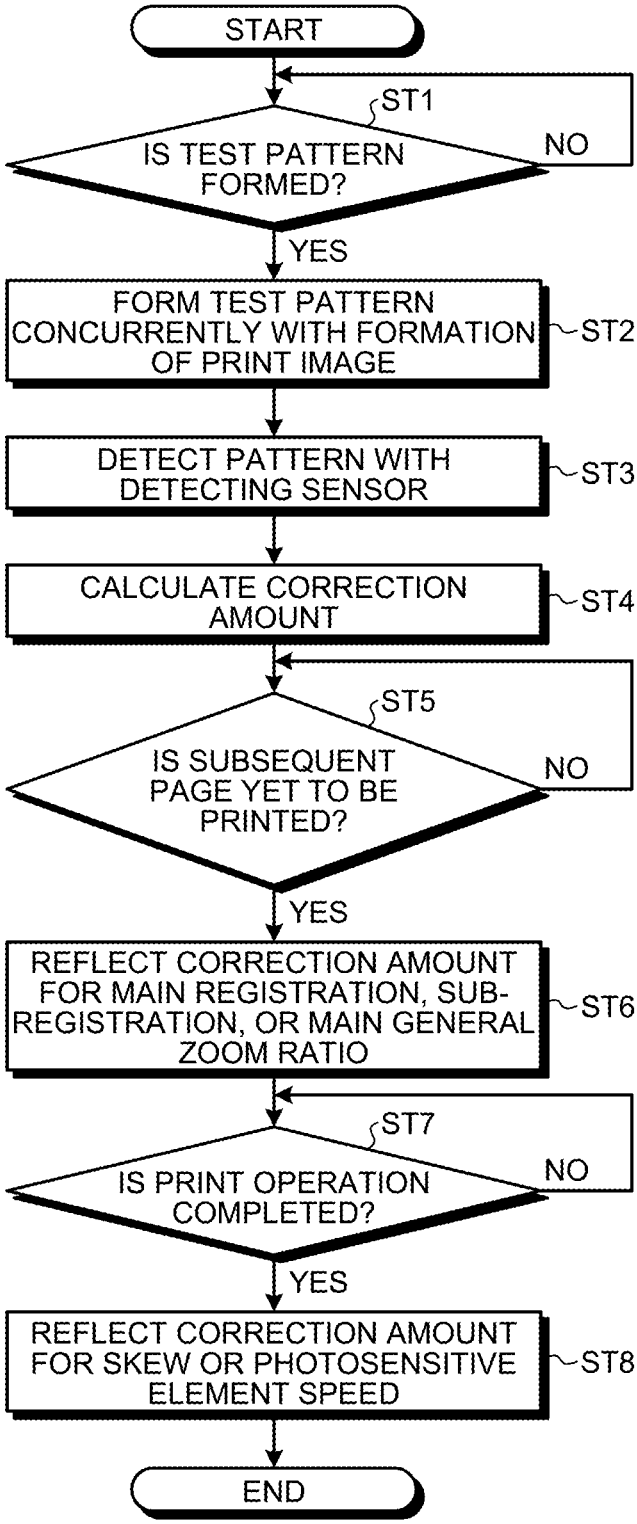
FIG. 8 is a flowchart illustrating a process for reflecting a color shift correction amount according to the first embodiment.

The abovementioned timing chart will be described in detail below. FIG. 8 is a flowchart illustrating a process for implementing the timing chart illustrated in FIG. 7. Specifically, at Step ST1, it is determined whether the correction test pattern 30 is to be formed at the start of the print operation. The determination is performed continuously until the correction test pattern 30 is formed (No at Step ST1). If the correction test pattern 30 is to be formed (Yes at Step ST1), the process proceeds to Step ST2 to form the correction test pattern 30 concurrently with the formation of the print image. Then, at Step ST3, the correction test pattern 30 is detected by the detecting sensors 5*a*, 5*c*. Then, at Step ST4, the color shift correction amounts are calculated from the correction test pattern 30 detected by the detecting sensors 5*a*, 5*c*.

Thereafter, at Step ST5, it is determined whether the subsequent page is yet to be printed. If the subsequent page has been printed (No at Step ST5), the color shift correction amounts are not reflected. If it is determined that the subsequent page is yet to be printed (Yes at Step ST5), at Step ST6, the correction amount, out of the calculated correction amounts, relating to at least one of the main scanning registration (main registration), the sub-scanning registration (sub-registration), and the main scanning general zoom ratio (main general zoom ratio) that constitute first correction items is reflected.

Then, the process proceeds to Step ST7. At Step ST7, it is determined whether the subsequent page is yet to be printed. If the subsequent page is being printed (No at Step ST7), the determination is performed continuously. Upon completion of the print operation (Yes at Step ST7), the process proceeds to Step ST8. At Step ST8, the color shift correction amount, out of the calculated correction amounts, relating to at least one of the skew correction (skew) and the photosensitive element speed that constitute second correction items is reflected. This enables the color shift correction amounts to be reflected without affecting the print operation, so that the print operation can be performed in which the color shift correction amounts are reflected on and after the next print operation.

In the first embodiment described above, the color shift correction amount that permits reflection within a short period of time is reflected before the print operation for the subsequent page is started and the color shift correction amount that takes time to be reflected is reflected after the completion of the print operation for the subsequent page. This precludes the likelihood that the reflection of the color shift correction amounts will overlap the image forming period. This suppresses time-related loss involved in the color shift correction, specifically, time loss in the image formation.

Second Embodiment

A second embodiment of the present invention will be described. In the first embodiment described above, the color shift correction amount that takes time to be reflected is reflected after the completion of the print operation for the subsequent page. If the color shift correction amount is reflected after the completion of the print operation and if a print request is received immediately after the completion of the print operation, however, the print operation for such a print request may not be able to be started until the correction amount is reflected. The second embodiment will be described below in which the color shift correction amounts relating to what-is-called the second correction items for which the correction amounts cannot be reflected before the start of the print operation for the subsequent page are reflected during a shutdown procedure through which the image forming apparatus 100 is brought into a standby state after the completion of the print operation.

Figure 9:
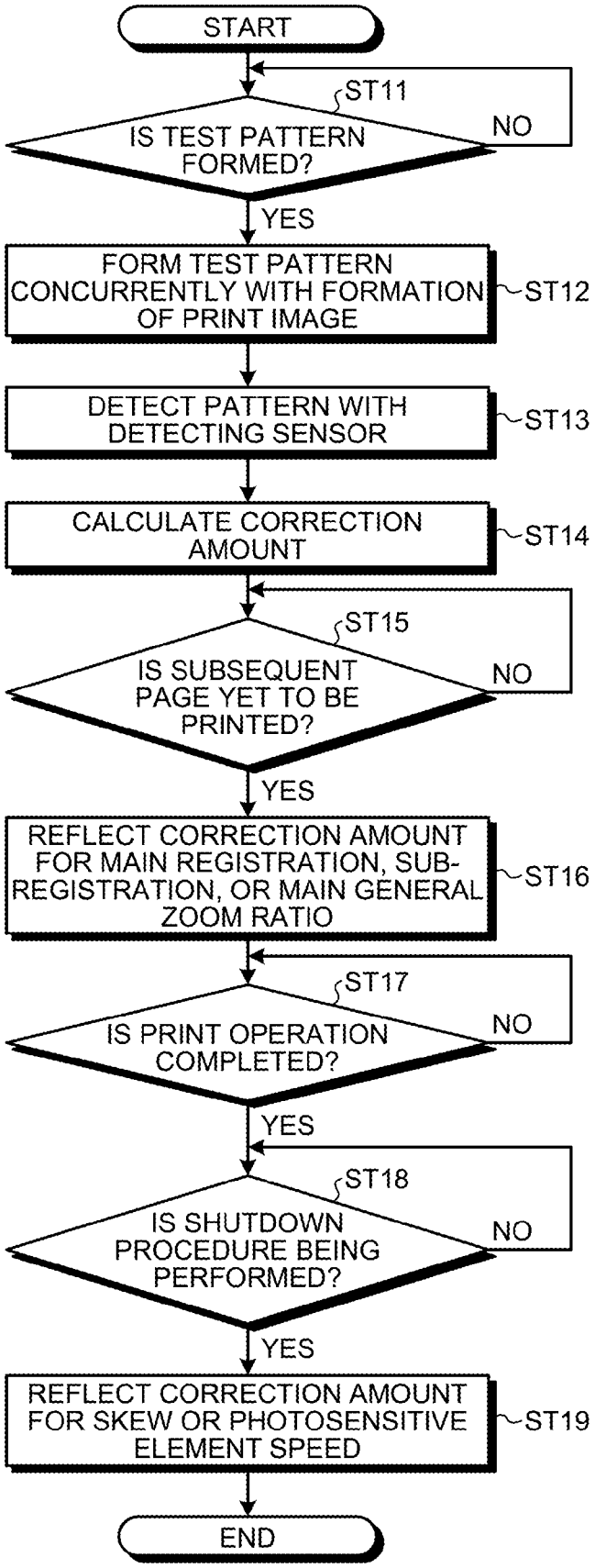
FIG. 9 is a flowchart illustrating a process for reflecting a correction amount during a shutdown procedure according to a second embodiment.

FIG. 9 is a flowchart illustrating the color shift correction process according to the second embodiment. As illustrated in FIG. 9, first at Step ST11, it is determined whether the correction test pattern 30 is to be formed at the start of the print operation. The determination is performed continuously until the correction test pattern 30 is formed (No at Step ST11). If the correction test pattern 30 is to be formed (Yes at Step ST11), the process proceeds to Step ST12 to form the correction test pattern 30 concurrently with the formation of the print image. Then, at Step ST13, the correction test pattern 30 is detected by the detecting sensors 5*a*, 5*c*. Then, at Step ST14, the color shift correction amounts are calculated from the correction test pattern 30 detected by the detecting sensors 5*a*, 5*c*.

Thereafter, at Step ST15, it is determined whether the subsequent page is yet to be printed. If the subsequent page has been printed (No at Step ST15), the color shift correction amounts are not reflected. If it is determined that the subsequent page is yet to be printed (Yes at Step ST15), at Step ST16, the correction amount, out of the calculated correction amounts, relating to at least one of the main scanning registration (main registration), the sub-scanning registration (sub-registration), and the main scanning general zoom ratio (main general zoom ratio) that constitute the first correction items is reflected.

Then, the process proceeds to Step ST17. At Step ST17, it is determined whether the subsequent page is yet to be printed. If the subsequent page is being printed (No at Step ST17), the determination is performed continuously. Upon completion of the print operation (Yes at Step ST17), the process proceeds to Step ST18.

At Step ST18, it is determined whether the shutdown procedure is being performed. If the shutdown procedure is not being performed (No at Step ST18), the determination is performed continuously. If the shutdown procedure is being performed (Yes at Step ST18), the color shift correction amount, out of the calculated correction amounts, relating to at least one of the skew correction (skew) and the photosensitive element speed that constitute the second correction items is reflected. This enables the color shift correction amounts to be reflected without affecting the print operation, so that the print operation can be performed in which the color shift correction amounts are reflected on and after the next print operation.

In the second embodiment, the color shift correction can be performed without widening the print intervals, which achieves effects identical to those achieved by the first embodiment. At the same time, the color shift correction amount relating to the second correction items is reflected during the shutdown procedure. This allows the correction amount to be reflected without affecting the print operation, so that the print operation in which the color shift correction is reflected can be performed on and after the subsequent power-up procedure.

Third Embodiment

Figure 10:
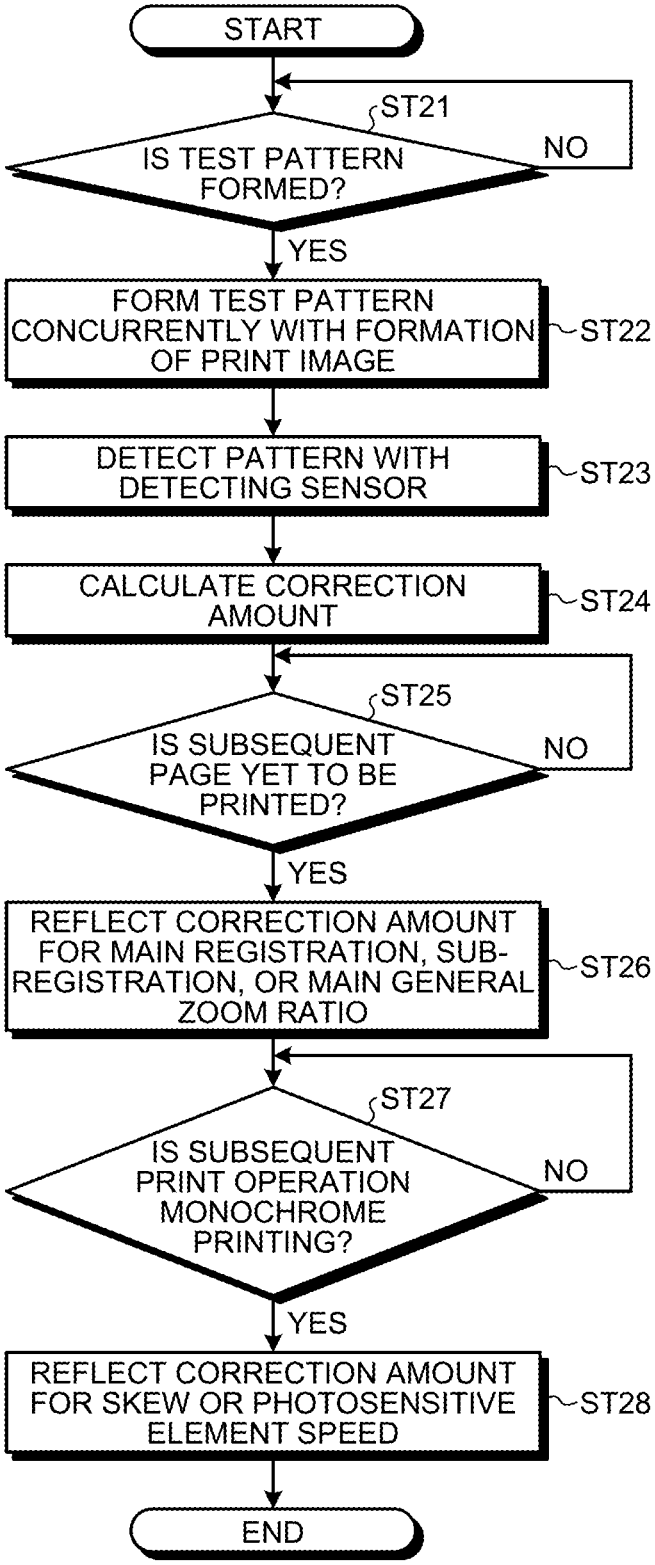
FIG. 10 is a flowchart illustrating a process for reflecting a correction amount during monochrome printing according to a third embodiment.

A third embodiment of the present invention will be described. FIG. 10 is a flowchart illustrating a process in which the color shift correction amount is reflected during monochrome printing that is to be performed next to print a monochrome page. As illustrated in FIG. 10, at Step ST21, it is determined whether the correction test pattern 30 is to be formed at the start of the print operation. The determination is performed continuously until the correction test pattern 30 is formed (No at Step ST21). If the correction test pattern 30 is to be formed (Yes at Step ST21), the process proceeds to Step ST22 to form the correction test pattern 30 concurrently with the formation of the print image. Then, at Step ST23, the correction test pattern 30 is detected by the detecting sensors 5*a*, 5*c*. Then, at Step ST24, the color shift amounts are calculated from the correction test pattern 30 detected by the detecting sensors 5*a*, 5*c*.

Thereafter, at Step ST25, it is determined whether the subsequent page is yet to be printed. If the subsequent page has been printed (No at Step ST25), the color shift correction amounts are not reflected. If it is determined that the subsequent page is yet to be printed (Yes at Step ST25), at Step ST26, the correction amount, out of the calculated correction amounts, relating to at least one of the main scanning registration (main registration), the sub-scanning registration (sub-registration), and the main scanning general zoom ratio (main general zoom ratio) that constitute the first correction items is reflected.

Then, the process proceeds to Step ST27. At Step ST27, it is determined whether the subsequent print operation is monochrome printing. If the subsequent print operation is not monochrome printing (No at Step ST27), the determination is performed continuously. If the subsequent print operation is monochrome printing (Yes at Step ST27), the process proceeds to Step ST28. At Step ST28, the color shift correction amount, out of the calculated correction amounts, relating to at least one of the skew correction (skew) and the photosensitive element speed that constitute the second correction items is reflected. This enables the color shift correction amounts to be reflected without affecting the print operation, so that the print operation can be performed in which the color shift correction amounts are reflected on and after the next print operation.

In the third embodiment described above, the effects identical to those achieved by the first embodiment can be achieved. In addition, when a print image of a monochrome page is formed during continuous printing operations, reflection of the second correction items for which reflection of the correction amounts cannot be completed before the print operation for the subsequent page does not affect the print image. Thus, the correction amounts can be reflected also during the period of a monochrome printing operation as a reflection-enabled period. For print operations in which monochrome and color pages are mixed with each other, therefore, time to complete the color shift correction can be shortened even further.

Figure 11:
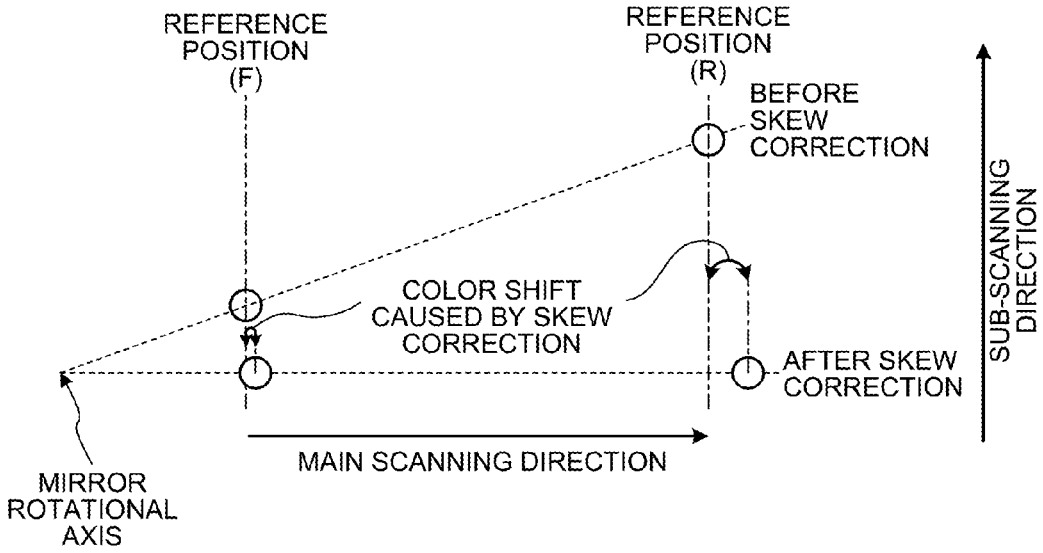
FIG. 11 is a schematic diagram for illustrating a case in which a correction amount is changed according to correction amount reflection timing.

In the first to third embodiments described above, the color shift correction amounts are reflected at least two different points in time. Printing operations may therefore be performed with a color shift not corrected until all of the correction amounts are reflected. FIG. 11 is a schematic diagram for illustrating a case in which a color shift correction amount is changed according to the timing at which to reflect the correction amount. As illustrated in FIG. 11, at points in time before and after skew correction, for example, the skew correction causes the inclination angle of the mirror to be changed. This results in different values of the misregistration amounts in the main-scanning direction and the sub-scanning direction, and the main scanning general zoom ratio before and after the skew correction.

The color shift amount can thus be made smaller by having different correction amounts for the correction item that is corrected before the printing operation for the subsequent page between two different cases, a first case being where the correction item that cannot be corrected before the printing operation for the subsequent page is not to be reflected and a second case being where the correction item that cannot be corrected before the printing operation for the subsequent page is to be reflected.

Specifically, for example, in the main-scanning direction, in a case in which a mirror rotational axis is rotated through $\theta$ (rad) after skew correction, correction is made to a value shifted by $L(1-\cos\theta)$ where L (m) is a distance from the mirror rotational axis to a reference position (the upper position marked with o). In the sub-scanning direction, the correction amount is found so that the central position of the reference position is a minimum before the skew correction; after the skew correction, correction is made so that the difference among the colors is a minimum so as to match the skew correction position. Calculating the correction amounts in consideration of the correction amount reflection timing as described above enables the optimum correction at each correction timing.

Figure 12:
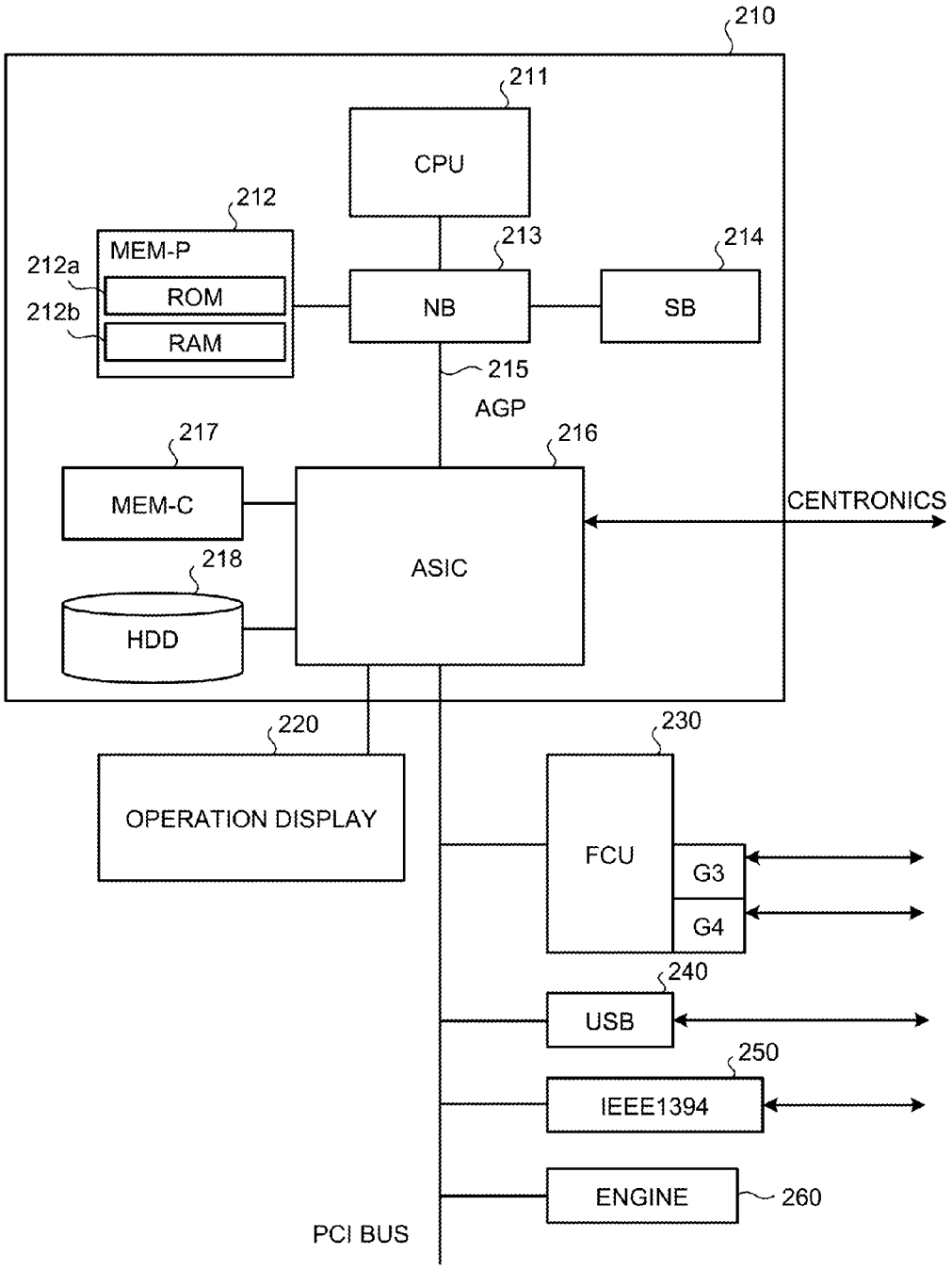
FIG. 12 is a block diagram illustrating a hardware configuration of the image forming apparatus according to the embodiment.

FIG. 12 is a block diagram illustrating a hardware configuration of the image forming apparatus 100 according to the embodiment. As illustrated in FIG. 12, the image forming apparatus 100 includes a controller 210 and an engine 260 connected to each other by a peripheral component interface (PCI) bus. The controller 210 controls generally the image forming apparatus 100, and drawing, communications, and inputs from an operating unit not illustrated. The engine 260 is a printer engine that can be connected to the PCI bus and may, for example, be a black-and-white plotter, a one-drum color plotter, a four-drum color plotter, a scanner, or a facsimile unit. In addition, the engine 260 further includes an image processing unit that performs, for example, error diffusion and gamma conversion, in addition to the engine such as the plotter.

The controller 210 includes a CPU 211, a north bridge (NB) 213, a system memory (MEM-P) 212, a south bridge (SB) 214, an application specific integrated circuit (ASIC) 216, a local memory (MEM-C) 217, and a hard disk drive (HDD) 218. The NB 213 and the ASIC 216 are connected by an accelerated graphics port (AGP) bus 215. Additionally, the MEM-P 212 includes a read only memory (ROM) 212*a* and a random access memory (RAM) 212*b*.

The CPU 211 controls generally the image forming apparatus 100 and includes a chip set including the NB 213, the MEM-P 212, and the SB 214. The CPU 211 is connected to other devices via the chip set.

The NB 213 is a bridge that connects the CPU 211 to the MEM-P 212, the SB 214, and the AGP 215. The NB 213 includes a memory controller that controls reading and writing relative to the MEM-P 212, a PCI master, and an AGP target.

The MEM-P 212 is a system memory used for, for example, storing and loading computer programs and data, and drawing for printers. The MEM-P 212 includes the ROM 212*a* and the RAM 212*b*. The ROM 212*a* is a read only memory used for storing computer programs and data. The RAM 212*b* is a readable/writable memory used for loading computer programs and data, and for drawing for printers.

The SB 214 is a bridge for connecting the NB 213 to the PCI bus and peripheral devices. The SB 214 and the NB 213 are connected by the PCI bus. A network interface (I/F) unit is also connected to the PCI bus.

The ASIC 216 is an integrated circuit (IC) for use in image processing including an image-processing hardware element. The ASIC 216 serves as a bridge that connects between the AGP 215, the PCI bus, the HDD 218, and the MEM-C 217. The ASIC 216 includes a PCI target, an AGP master, an arbiter (ARB) that is a core of the ASIC 216, a memory controller that controls the MEM-C 217, a plurality of direct memory access controller (DMAC) for rotating image data through, for example, hardware logic, and a PCI unit that transfers data to or from the engine 260 via the PCI bus. A facsimile control unit (FCU) 230, a universal serial bus (USB) 240, and an Institute of Electrical and Electronics Engineers 1394 (IEEE 1394) interface 250 are connected to the ASIC 216 via the PCI bus. An operation display 220 is directly connected to the ASIC 216.

The MEM-C 217 is a local memory used as a copying image buffer and a code buffer. The HDD 218 is a storage that stores therein image data, computer programs, font data, and formats.

The AGP 215 is a bus interface for a graphics accelerator card developed for enabling graphics processing at high speed. The AGP 215 makes the graphics accelerator card support high speed by directly accessing the MEM-P 212 at high throughput.

The computer program to be executed by the image forming apparatus according to the embodiment is provided by being incorporated in advance in, for example, a ROM. The computer program to be executed by the image forming apparatus according to the embodiment may be configured so as to be provided by being recorded on a computer-readable recording medium, such as a compact disc-read only memory (CD-ROM), a flexible disk (FD), a compact disc-recordable (CD-R), a digital versatile disk (DVD), and a Blu-ray disc (BD) (trademark) in a file in an installable format or an executable format.

The computer program to be executed by the image forming apparatus according to the embodiment may also be configured so as to be provided by being stored in a computer connected to a network such as the Internet and downloaded over the network. The computer program to be executed by the image forming apparatus according to the embodiment may still be configured so as to be provided or distributed over a network such as the Internet.

The computer program to be executed by the image forming apparatus according to the embodiment has a modular configuration including each of the above-described elements (controllers). The CPU (processor) as actual hardware loads the computer program from the ROM and executes it. This loads the above-described elements on a main storage and achieves the above-described elements on the main storage.

The image forming apparatus according to the embodiment of the present invention has been described for a case in which the image forming apparatus is applied to a multifunction peripheral having at least two of the copier, printer, scanner, and facsimile functions. Nonetheless, the image forming apparatus according to the embodiment of the present invention can be applied to any type of image forming apparatus, such as a copier, a printer, a scanner, and a facsimile unit.

Additionally, the CPU 20, the RAM 21, the ROM 22, and the like illustrated in FIG. 4 may be configured in common with, or separately from, the CPU 211, the ROM 212*a*, and the RAM 212*b* illustrated in FIG. 12.

The present invention enables color shift correction in an image forming apparatus without allowing time loss or time-related loss to occur.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

at least one first image carrier configured to carry an electrostatic latent image thereon;

an image writing unit configured to write the electrostatic latent image onto the at least one first image carrier, the electrostatic latent image including a test pattern;

a second image carrier configured to move along a transfer position facing to the at least one first image carrier to obtain a subject image by transferring the electrostatic latent image carried on the at least one first carrier onto the second image carrier in a superimposing manner;

an image forming unit provided in contact with the second image carrier and configured to transfer the subject image transferred on the second image carrier to a transfer material and convey the transfer material;

a detector configured to detect the test pattern image; and a controller configured to correct an image forming condition of the subject image based on the detection result from the detector, wherein during a time period from the start of detecting the test pattern by the detector to the start of writing a subsequent subject image onto the at least one first image carrier by the image writing unit, the controller calculates an amount of at least one correction matter from the detection result from the detector, and reflects the calculated amount in the image forming condition of the subject image.

2. The image forming apparatus set forth in claim 1, wherein the at least one correction matter includes a main scanning misregistration, sub-scanning misregistration, and a main scanning general zoom ratio.

3. The image forming apparatus set forth in claim 1, wherein for at least one delay correction matter being incapable of calculating the correction amount thereof and reflecting the calculated amount in the image forming condition of the subject image during a time period from the start of detecting the test pattern by the detector to the start of writing a subsequent subject image onto the at least one first image carrier by the image writing unit, the controller calculates the amount of the at least one delay correction matter and reflects the calculated amount in the image forming condition of the subject image during an idle period that the image writing unit does not write the electrostatic latent image onto the at least one first image carrier.

4. The image forming apparatus set forth in claim 3, wherein the at least one delay correction matter is at least one of skew correction and photosensitive element speed correction.

5. The image forming apparatus set forth in claim 3, wherein the idle period starts at a time when it is at least the end of a print operation, during a shutdown procedure, and before formation of an adjustment pattern performed at longer time intervals between print operations.

6. The image forming apparatus set forth in claim 3, wherein the idle period starts at the beginning of a monochrome printing, the controller calculates the amount of at least one of correction matter for a color other than colors the subject image being formed, and the controller reflects the calculated amount in the image forming condition of the subject image.

7. The image forming apparatus set forth in claim 3, wherein the controller calculates the amount of the correction matter and the amount of the delay correction matter independently, and the controller calculates the amount of the delay correction matter during the idle period.

8. A method for performing image correction using an image forming apparatus, the image forming apparatus comprising:

at least one first image carrier configured to carry an electrostatic latent image thereon;

an image writing unit configured to write the electrostatic latent image onto the at least one first image carrier, the electrostatic latent image including a test pattern;

a second image carrier configured to move along a transfer position facing to the at least one first image carrier to obtain a subject image by transferring the electrostatic latent image carried on the at least one first carrier onto the second image carrier in a superimposing manner;

an image forming unit provided in contact with the second image carrier, and configured to transfer the subject image transferred on the second image carrier to a transfer material and convey the transfer material;

a detector configured to detect the test pattern image; and a controller configured to correct an image forming condition of the subject image based on the detection result from the detector, the method comprising:

by the detector, detecting the test pattern image;

by the controller, during a time period from the start of detecting the test pattern by the detector to the start of writing a subsequent subject image onto the at least one first image carrier by the image writing unit, calculating an amount of at least one correction matter from the detection result from the detector, and reflecting the calculated amount in the image forming condition of the subject image; and for at least one delay correction matter being incapable of calculating the correction amount thereof and reflecting the calculated amount in the image forming condition of the subject image during a time period from the start of detecting the test pattern by the detector to the start of writing a subsequent subject image onto the at least one first image carrier by the image writing unit, by the controller, calculating the amount of the at least one delay correction matter and reflecting the calculated amount in the image forming condition of the subject image during an idle period that the image writing unit does not write the electrostatic latent image onto the at least one first image carrier.

9. A computer readable storage medium storing a computer program, the computer program comprising instructions which, when caused by a computer, causes the computer to perform operations for performing image correction using an image forming apparatus, the image forming apparatus comprising:

at least one first image carrier configured to carry an electrostatic latent image thereon;

an image writing unit configured to write the electrostatic latent image onto the at least one first image carrier, the electrostatic latent image including a test pattern;

a second image carrier configured to move along a transfer position facing to the at least one first image carrier to obtain a subject image by transferring the electrostatic latent image carried on the at least one first carrier onto the second image carrier in a superimposing manner;

an image forming unit provided in contact with the second image carrier and configured to transfer the subject image transferred on the second image carrier to a transfer material and convey the transfer material;

a detector configured to detect the test pattern image; and a controller configured to correct an image forming condition of the subject image based on the detection result from the detector, the operations comprising:

by the detector, detecting the test pattern image;

by the controller, during a time period from the start of detecting the test pattern by the detector to the start of writing a subsequent subject image onto the at least one first image carrier by the image writing unit, calculating an amount of at least one correction matter from the detection result from the detector, and reflecting the calculated amount in the image forming condition of the subject image; and for at least one delay correction matter being incapable of calculating the correction amount thereof and reflecting the calculated amount in the image forming condition of the subject image during a time period from the start of detecting the test pattern by the detector to the start of writing a subsequent subject image onto the at least one first image carrier by the image writing unit, by the controller, calculating the amount of the at least one delay correction matter and reflecting the calculated amount in the image forming condition of the subject image during an idle period that the image writing unit does not write the electrostatic latent image onto the at least one first image carrier.

* * * * *